US006598446B2

(12) United States Patent
Meliga

(10) Patent No.: US 6,598,446 B2
(45) Date of Patent: Jul. 29, 2003

(54) BENDING MACHINE FOR PIPES, SECTIONS OR SIMILAR

(75) Inventor: Mauro Meliga, Rivarossa (IT)

(73) Assignee: Tauring S.p.A., Leini (IT)

( * ) Notice: Subject to any disclaimer, the term of this patent is extended or adjusted under 35 U.S.C. 154(b) by 0 days.

(21) Appl. No.: 10/008,315

(22) Filed: Nov. 3, 2001

(65) Prior Publication Data

US 2002/0104354 A1 Aug. 8, 2002

Related U.S. Application Data

(63) Continuation of application No. PCT/IT00/00110, filed on Mar. 29, 2000.

(30) Foreign Application Priority Data

May 4, 1999 (IT) ..... TO99A0364

(51) Int. Cl.[7] ..... B21D 7/08
(52) U.S. Cl. ..... 72/174; 72/175; 72/307
(58) Field of Search ..... 72/166, 170, 173–175, 72/307

(56) References Cited

U.S. PATENT DOCUMENTS

| | | | | | |
|---|---|---|---|---|---|
| 471,301 A | * | 3/1892 | Keene | ..... | 72/178 |
| 1,857,325 A | * | 5/1932 | Ottenstein | ..... | 72/171 |
| 4,367,641 A | * | 1/1983 | Mizutani | ..... | 72/307 |
| 4,391,116 A | * | 7/1983 | Yogo | ..... | 72/168 |
| 4,653,301 A | * | 3/1987 | Meliga | ..... | 72/175 |
| 5,425,257 A | * | 6/1995 | Kitsukawa et al. | ..... | 72/168 |
| 5,884,517 A | * | 3/1999 | Yogo | ..... | 72/166 |

FOREIGN PATENT DOCUMENTS

| | | | | |
|---|---|---|---|---|
| DE | 27 44 420 | * | 4/1979 | ..... 72/168 |
| DE | 197 21 654 A | | 10/1998 | |
| DE | 197 21 654 A | | 12/1998 | |
| EP | 405 600 A | | 1/1991 | |
| JP | 02 280921 | | 2/1991 | |

* cited by examiner

*Primary Examiner*—Daniel C. Crane
(74) *Attorney, Agent, or Firm*—Kenneth L. Sherman, Esq.; Myers Dawes Andras & Sherman; Vic Y. Lin, Esq.

(57) ABSTRACT

A machine for bending pipes (2; 63; 78) sections or similar of a given section (S1; S2; S3) has a guide device (6) having a longitudinal axis (9) for guiding the pipes (2; 63; 78) in a feed direction (D1) parallel to the axis (9); and a bending member (7) movable with respect to the guide device (6) in a plane (P1) perpendicular to the feed direction (D1), and having an annular guide (50), which has a passage section (45; 61; 76) for the pipes (2; 63; 78) substantially equal to the section (S1; S2; S3) of the pipes (2; 63; 78) and is defined by rollers (40; 52; 82; 67) rotating about respective axes (41; 53; 83; 68) lying in a plane coplanar with the passage section (45; 61; 76).

13 Claims, 8 Drawing Sheets

S1
D1
D2
P1
III
1b

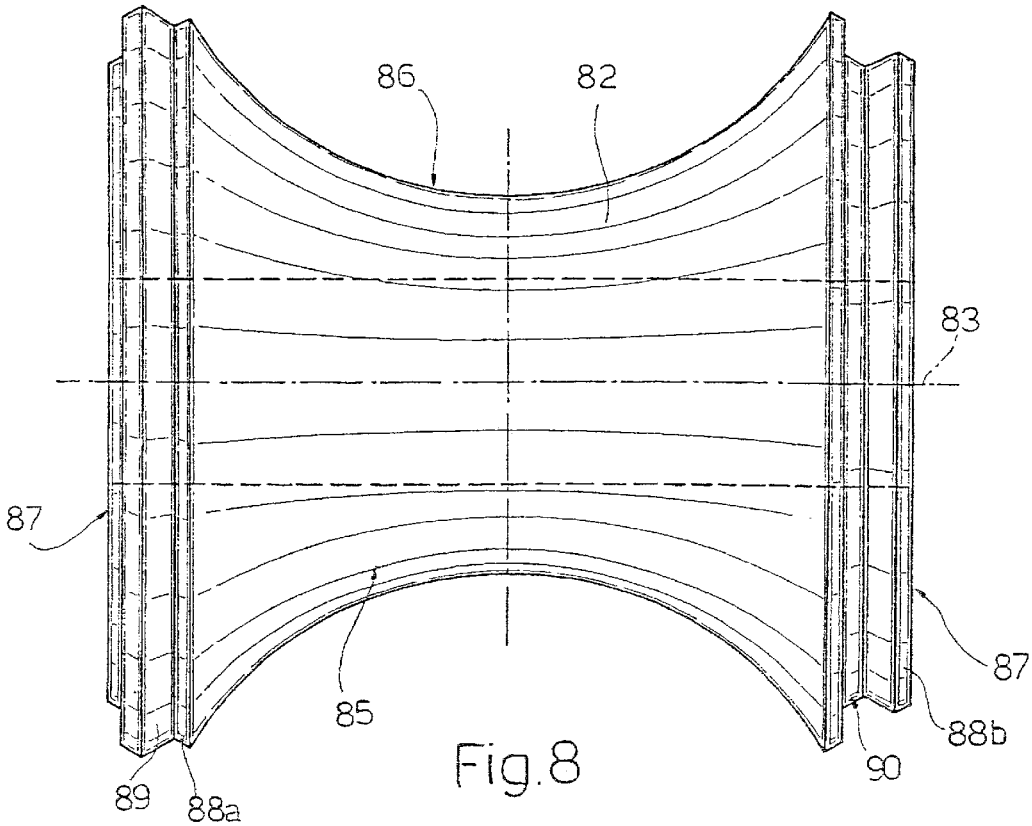
Fig.8
Fig.9
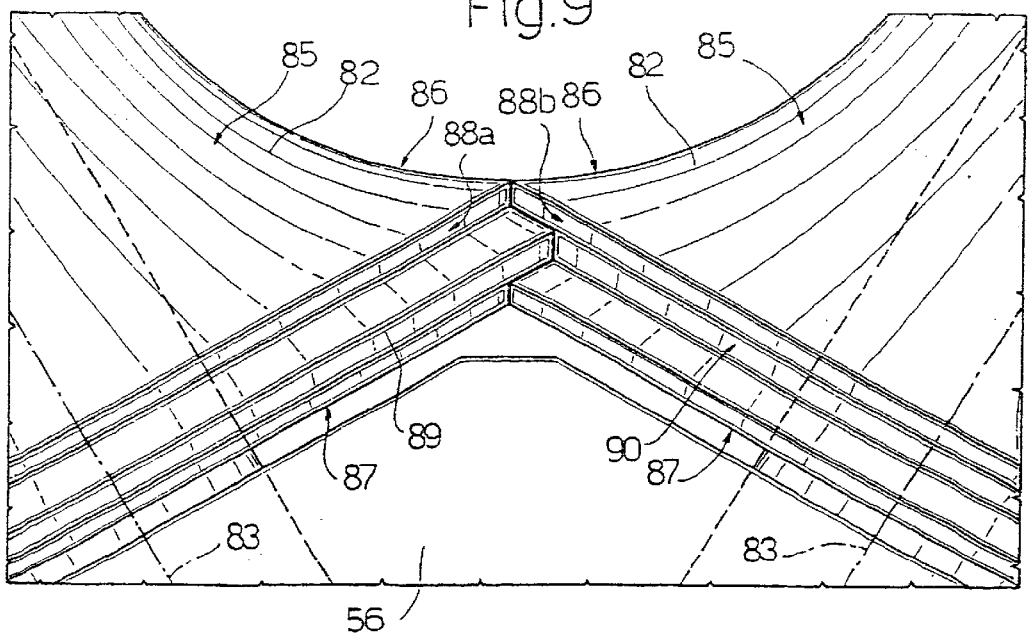

BENDING MACHINE FOR PIPES, SECTIONS OR SIMILAR

This application is a continuation of PCT/IT00/00110, filed Mar. 29, 2000.

TECHNICAL FIELD

The present invention relates to a bending machine for pipes, sections or similar.

The machine according to the present invention is a penetration-type pipe bending machine. Penetration-type bending machines comprise a fixed guide device having a longitudinal axis, for guiding the pipes in a feed direction; and a bending member movable with respect to the guide in a plane perpendicular to the longitudinal axis, and in turn comprising an annular guide, which, as the pipe is fed forward, deflects the pipe by displacement of the bending member in said plane.

BACKGROUND ART

The annular guide of known machines is made of sintered material, and has a circular pipe passage section substantially equal to the section of the straight pipe, so as to guide the pipe accurately and obtain precise bends.

Though extremely accurate, penetration machines of the above type have several drawbacks, on account of the annular guide requiring continuous lubrication to reduce friction between the pipe walls and the guide itself. Such machines therefore require a lubricating system, as well as degreasing of the bent pipes. Moreover, on account of the friction between the pipe and annular guide—still considerable despite lubrication—considerable force is required to push the pipe in the feed direction, thus possibly resulting in damage to straight pipes with thin or easily deformable walls.

Moreover, known sintered annular guides cannot be formed with polygonal passage sections, on account of the highly fragile nature of the corners, so that known bending machines of the above type cannot be used for bending polygonal-section pipes.

DISCLOSURE OF INVENTION

It is an object of the present invention to provide a pipe bending machine of the above type, designed to eliminate the drawbacks of the known state of the art.

According to the present inventions there is provided a pipe bending machine as claimed in claim 1.

BRIEF DESCRIPTION OF THE DRAWINGS

A non-limiting embodiment of the present invention will be described by way of example with reference to the accompanying drawings, in which:

FIG. 8 shows a larger-scale detail of the FIG. 7 variation;

FIG. 9 shows a further detail of the FIG. 7 variation.

BEST MODE FOR CARRYING OUT THE INVENTION

Figures 1, 1B:
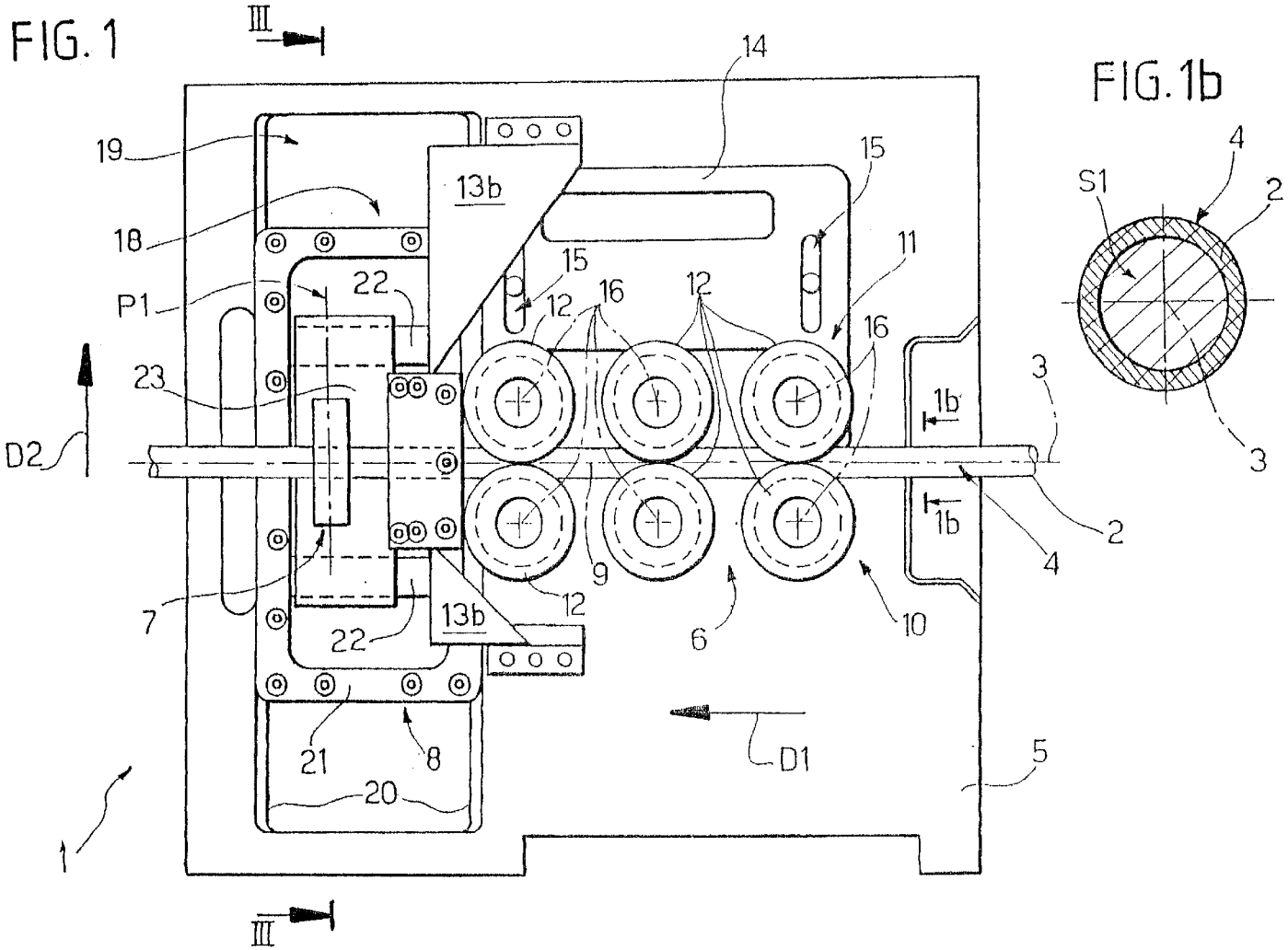
FIG. 1 shows a plan view, with parts removed for clarity, of a machine in accordance with the present invention.
FIG. 1*b* shows a section along line Ib—Ib of a pipe to be bent on the FIG. 1 machine.
Figure 2:
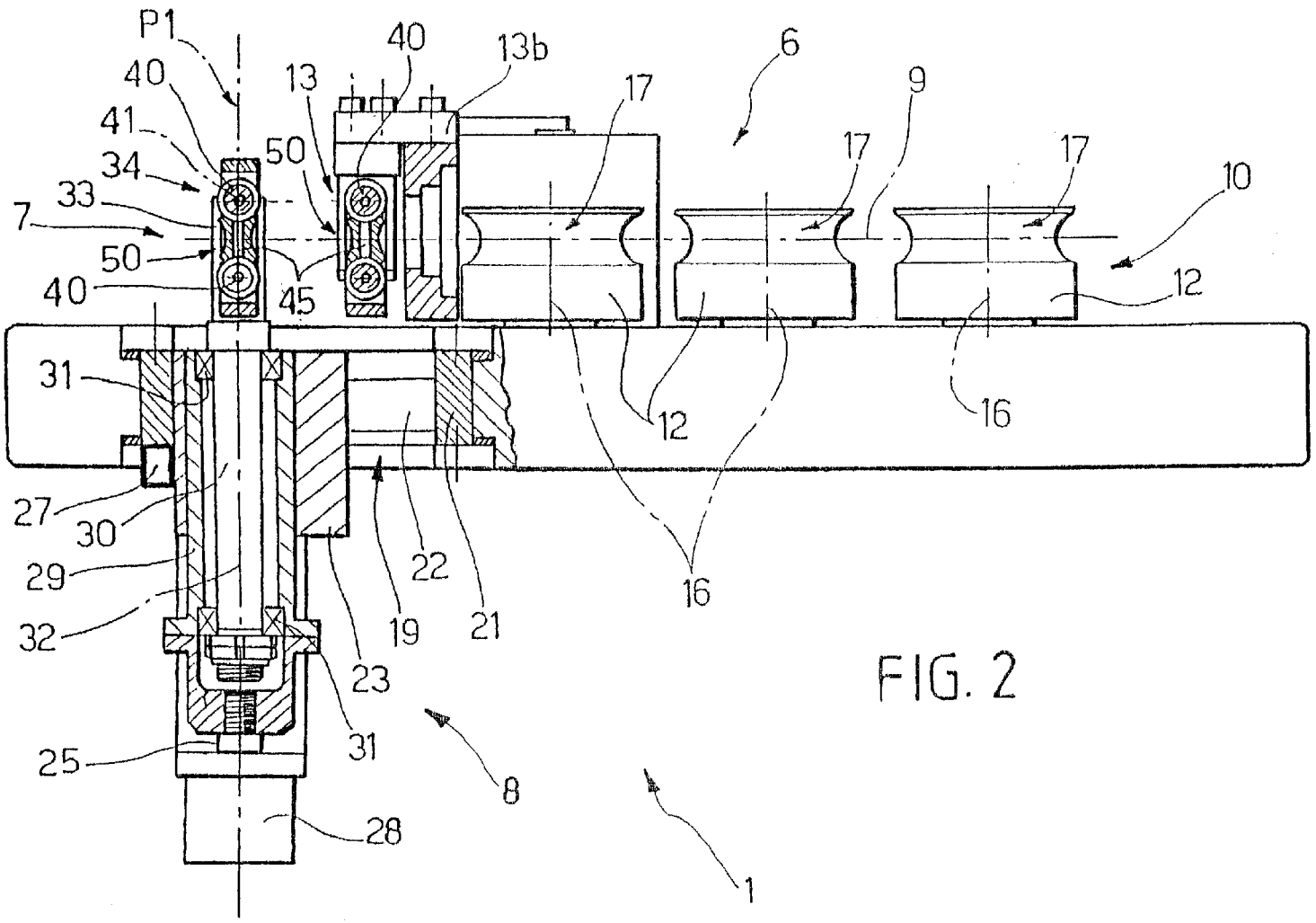
FIG. 2 shows a lateral elevation of the FIG. 1 machine, with parts removed for clarity and parts shown partially in section.
Figure 3:
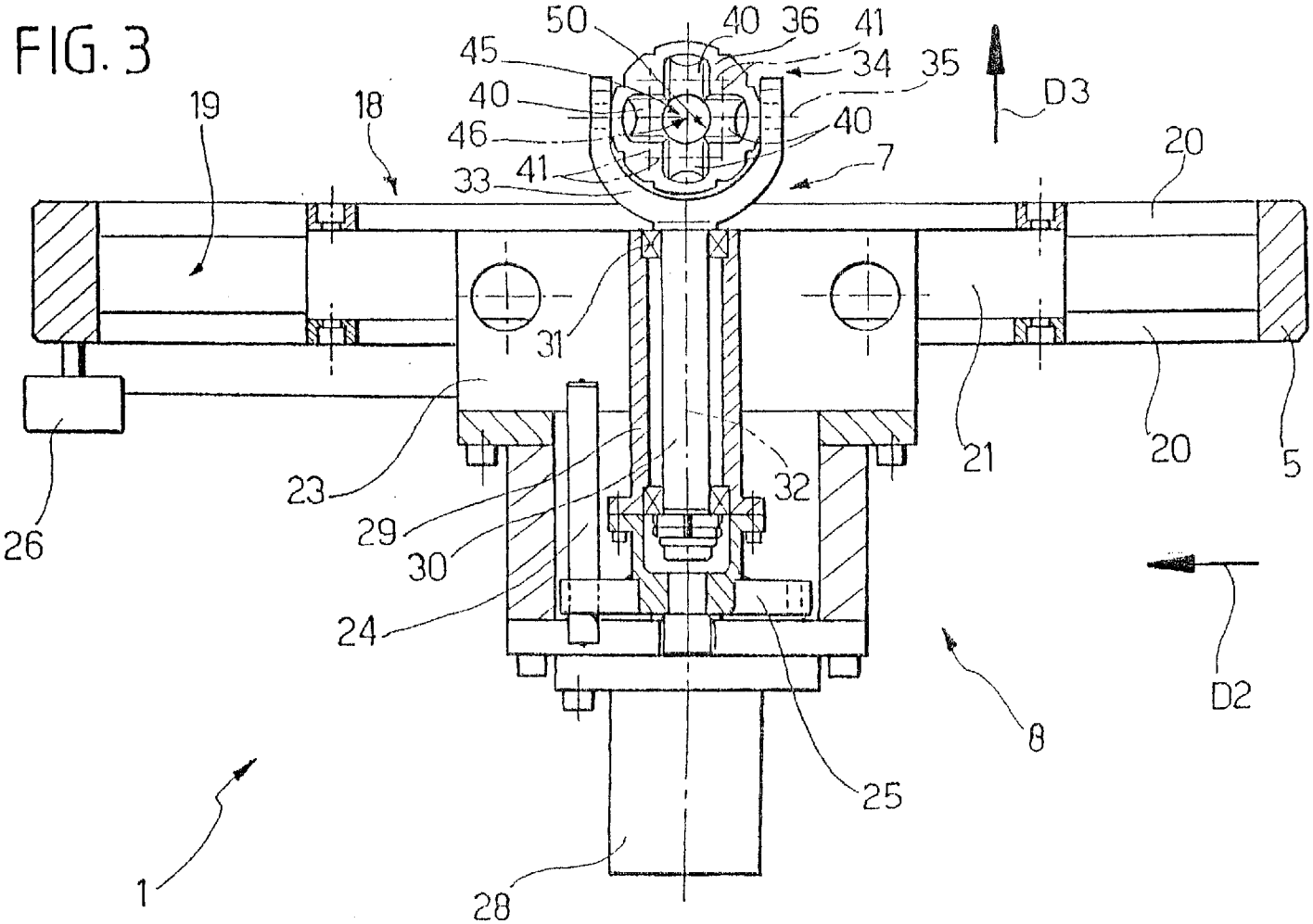
FIG. 3 shows a section, with parts removed for clarity, along line III—III of the FIG. 1 machine.

Number 1 in FIGS. 1, 2 and 3 indicates a penetration-type bending machine for bending pipes 2, sections or similar having a straight axis 3, a cylindrical outer surface 4, and a circular section S1.

Machine 1 comprises a supporting plate 5, a guide device 6, a bending member 7, and an actuating assembly 8 for operating member 7. Plate 5 supports guide device 6 and assembly 8, which in turn supports bending member 7.

Guide device 6 has an axis 9, and comprises two sets 10 and 11 of rollers 12 located on opposite sides of axis 9 of device 6; and an annular guide head 13 fitted to plate 5 by a frame 13*b*. Set 10 of rollers 12 is fixed, whereas set 11 of rollers 12 is fitted to a plate 14, which has slots 15 extending perpendicularly to axis 9 and is adjustable crosswise to axis 9 with respect to plate 5 and set 10.

Each roller 12 rotates about a respective vertical axis 16 of rotation, and has a respective surface 17 of revolution which mates with part of outer surface 4 of pipe 2. At least two of rollers 12 facing each other on opposite sides of axis 9 are drive rollers; and are activated by a known transmission (not shown) to feed pipe 2 in a horizontal feed direction D1 parallel to axis 9.

Actuating assembly 8 comprises a slide 18 housed inside an opening 19 in plate 5 and mounted to slide along two guides 20 extending in a horizontal direction D2 perpendicular to direction D1 and along opposite edges of opening 19. Slide 18 comprises a frame 21, and two bars 22 supported by frame 21 and extending in direction D1.

Assembly 8 comprises a box-shaped slide 23, which slides along bars 22 in direction D1 and supports a vertical guide 24, along which runs a slide 25 integral with bending member 7. Slide 25 and bending member 7 are movable, with respect to slides 18 and 23 and plate 5, in a vertical direction D3 perpendicular to directions D1 and D2.

Assembly 8 also comprises a drive member 26 integral with plate 5 to move slide 18 with respect to plate 5 in direction D2; a drive member 27 integral with slide 18 to move slide 23 in direction D1 with respect to slide 18; and a drive member 28 integral with slide 23 to move slide 25 in direction D3. The combined movements of slides 18 and 25 provide for setting bending member 7 to a number of positions in a plane P1 perpendicular to direction D1, while the movements of slide 23 provide for adjusting the distance between member 7 and guide head 13 and, hence, the distance between plane P1 and head 13.

Figure 4:
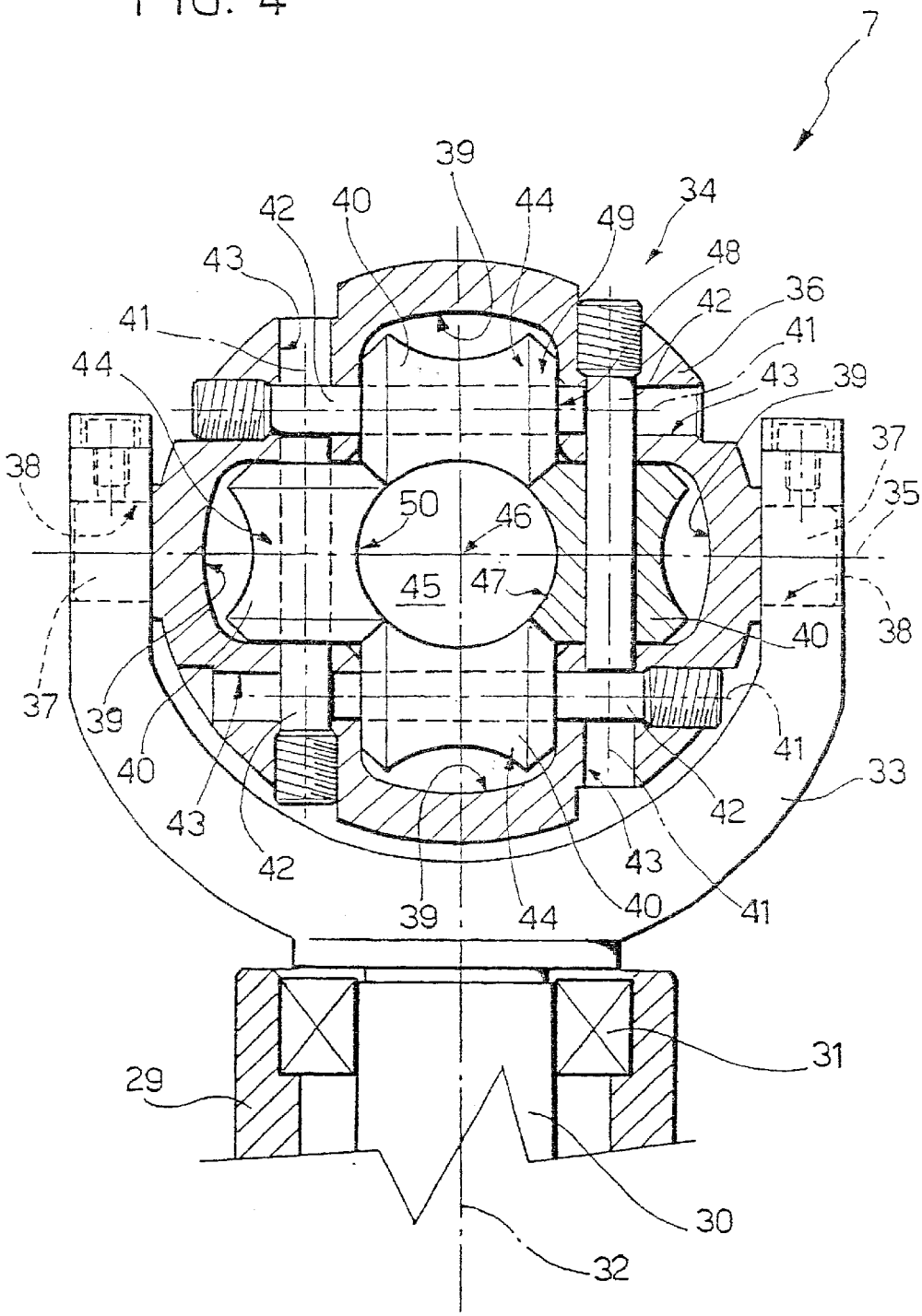
FIG. 4 shows a front elevation of a detail of the FIG. 1 machine.

With reference to FIG. 4, bending member 7 comprises a sleeve 29 integral with slide 25; and a shaft 30, which is fitted inside sleeve 29 by means of bearings 31, rotates with respect to sleeve 29 about a respective axis 32 parallel to direction D3, and has a fork 33 at the top end.

Fork 33 supports a bending head 34, which rotates with respect to fork 33 about an axis 35 perpendicular to axis 32. Head 34 comprises an annular body 36, which in turn comprises two pins 37 engaging respective holes 38 in fork 33, and four seats 39 housing respective rollers 40.

Each roller 40 rotates about a respective axis 41, and is fitted to a respective pin 42 extending along respective axis 41 and supported at the ends inside respective holes 43 in annular body 36.

Each roller 40 has a toroidal surface 44 of revolution adjacent to and contacting the surfaces 44 of the adjacent rollers 40, so as to form a circular passage section 45 substantially equal to section S1 of pipe 2. Section 45 has a barycenter 46, which substantially represents the center of a circle equal to passage section 45 and to section S1 of pipe 2. In other words, surfaces 44 of rollers 40 are defined by rotating about respective axes 41 generating lines 47 equal to a 90° arc of a circle defined by passage section 45. Axes 41 of rollers 40 are coplanar with one another and with passage section 45.

Each roller 40 also comprises two lateral surfaces 48 perpendicular to axis 41; and two truncated-cone-shaped surfaces 49 connecting surface 44 of revolution and lateral surfaces 48. Connecting surfaces 49 slope at a 45° angle with respect to axis 35, and contact connecting surfaces 49 of the adjacent rollers 40 along respective generating lines of surfaces 49. That is, rollers 40 define an annular guide 50, the shape of which depends on surfaces 44 of revolution.

Guide head 13 of device 6 is substantially identical with head 34, and therefore defines an annular guide 50 with a passage section 45, and is fixed to plate 5 between rollers 12 and bending member 7. Head 13 therefore also comprises four rollers 40 rotating about respective axes 41 and defining annular guide 50.

In actual use, machine 1 for bending pipes 2 operates as follows. A straight pipe 2 is positioned between sets 10 and 11 of rollers 12, with axis 3 aligned with axis 9 of guide device 6, and drive rollers 12 feed pipe 2 in direction D1 through guide head 13. Bending member 7 is so positioned that head 34 is aligned with and a given distance from head 13; which distance is selected according to the required bend angle of pipe 2, and is adjusted by means of drive member 27 and slide 23. Pipe 2 is fed further forward through head 34 of member 7, at which point, bending member 7 is moved along plane P1 according to a bending program, which, by means of a known central control unit (not shown), controls drive members 26 and 28 to move slides 18 and 25 in respective directions D2 and D3. As pipe 2 bends, head 34 is oriented about axes 32 and 35 to minimize resistance to the forward feed of pipe 2, and to position passage section 45 perpendicular to axis 3 of the bent pipe 2. As it is fed through head 34, pipe 2 is guided by rollers 40 rotating about respective axes 41.

Both rotation of rollers 40 of heads 13 and 34 and oscillation of head 34 about axes 32 and 35 provide for minimizing friction between pipe 2 and guide device 6, and between pipe 2 and bending member 7.

Head 34 is supported interchangeably by fork 33, and can be replaced with other bending heads with passage sections of different shapes and sizes.

Figure 5B:
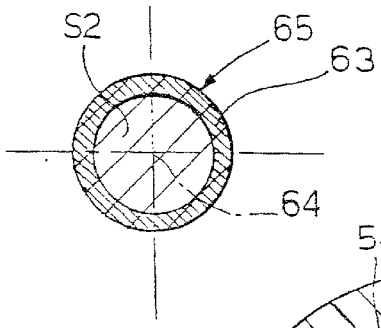
FIG. 5*b* shows a cross section of a circular-section pipe.
Figure 5:
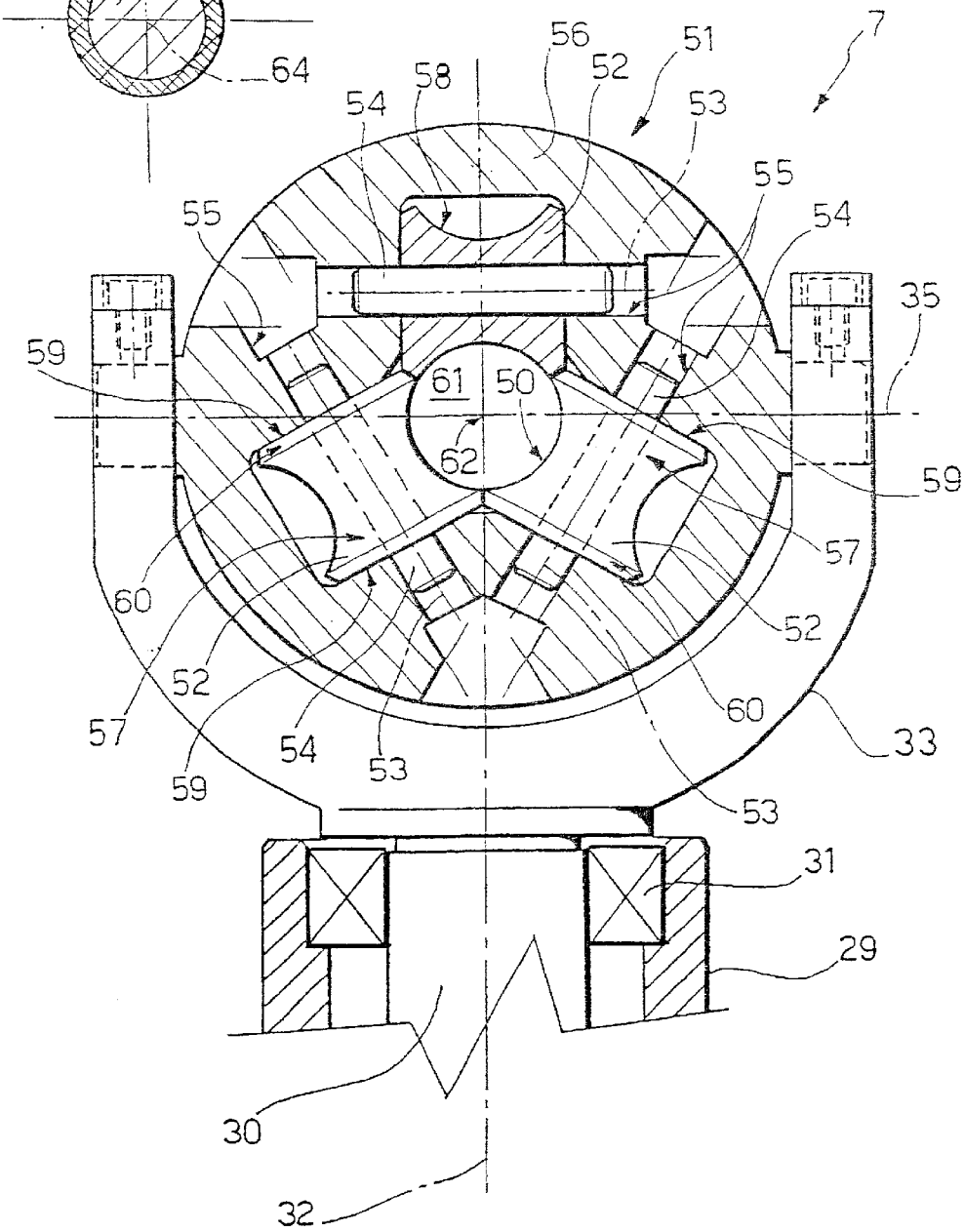
FIG. 5 shows a front elevation of a first variation of the FIG. 4 detail.

In the FIG. 5 variation, bending member 7 comprises a bending head 51, wherein angular guide 50 is defined by three rollers 52 rotating about respective axes 53 and supported by respective pins 54 housed inside holes 55 in an annular body 56. Each roller 52 comprises a surface 57 generated by rotation of a generating line 58 corresponding to a 120° arc. Like rollers 40, each roller 52 comprises two lateral surfaces 59; and two connecting surfaces 60, the generating lines of which contact those of the connecting surfaces of the adjacent rollers 52. In the above variation, annular guide 50 has a circular passage section 61 with a barycenter 62, for bending pipes 63, which, as shown in FIG. 5*b*, comprise an axis 64, an outer surface 65, and a section 52 smaller than section S1. Though the above variation refers to bending member 7; head 51 may obviously be used in place of head 13.

Figure 6B:
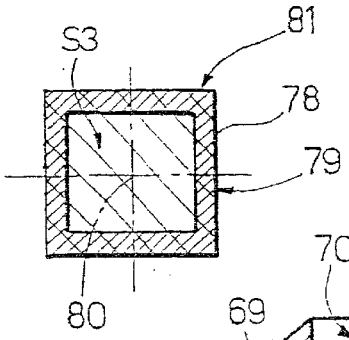
FIG. 6*b* shows a cross section of a square-section pipe.
Figure 6:
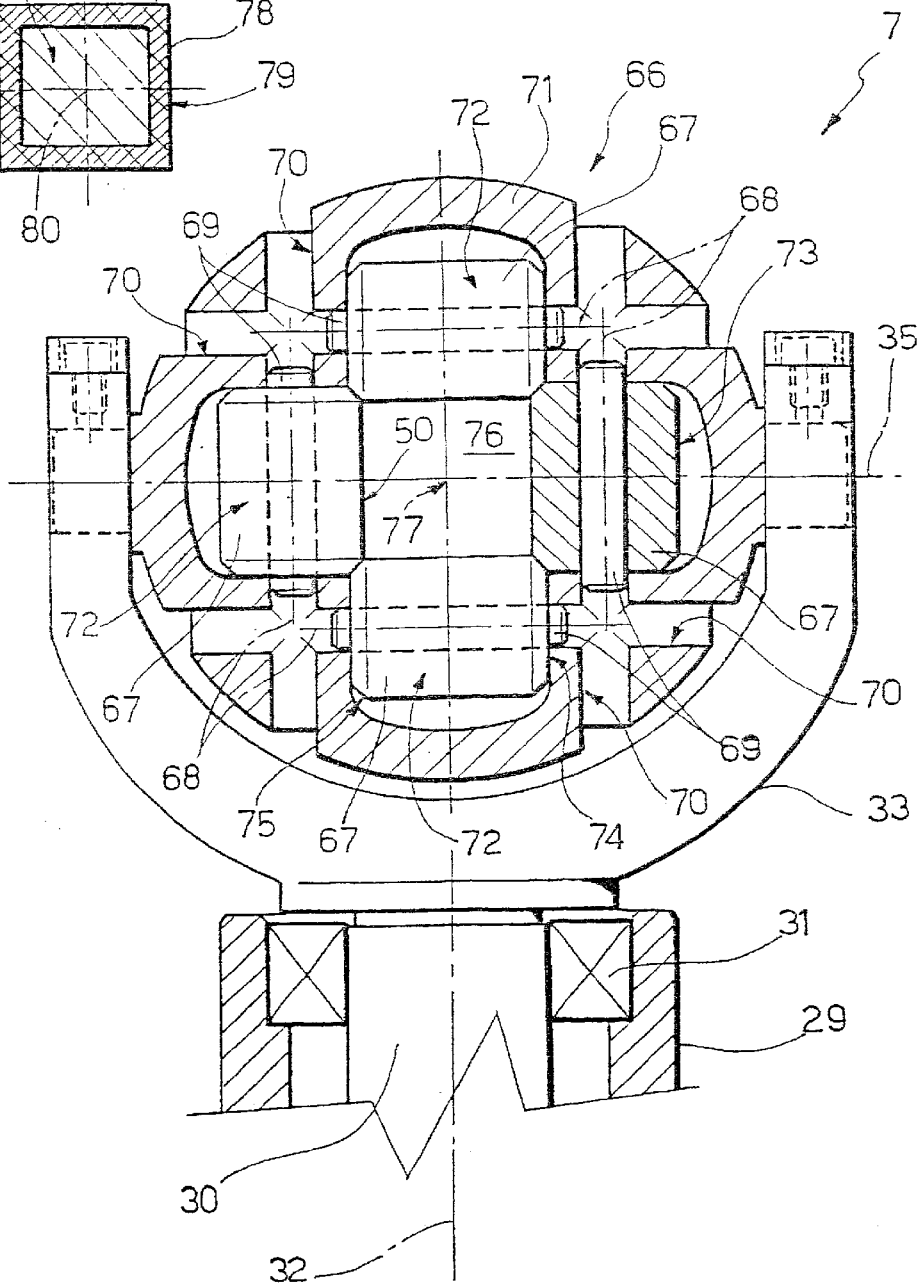
FIG. 6 shows a front elevation of a second variation of the FIG. 4 detail.

In the FIG. 6 variation, bending member 7 comprises a bending head 66, wherein annular guide 50 is defined by four rollers 67 rotating about respective axes 68 and supported by respective pins 69 housed inside holes 70 in an annular body 71. Each roller 67 comprises a cylindrical surface 72 generated by rotation of a generating line 73 equal to a straight segment. Like rollers 40, each roller 67 comprises two lateral surfaces 74; and two connecting surfaces 75, the generating lines of which contact those of connecting surfaces 75 of the adjacent rollers 67. In the above variation, annular guide 50 defines a square passage section 76 with a barycenter 77, and bending head 66 is used to bend pipes 78 comprising a square section S3 with sides 79, an axis 80, and a lateral surface 81. In this case, generating line 73 substantially equals the dimension of side 79 of section S3 of pipe 78.

Though, in this case also, the above variation refers to bending member 7, head 13 must obviously be replaced with head 66.

Figure 7:
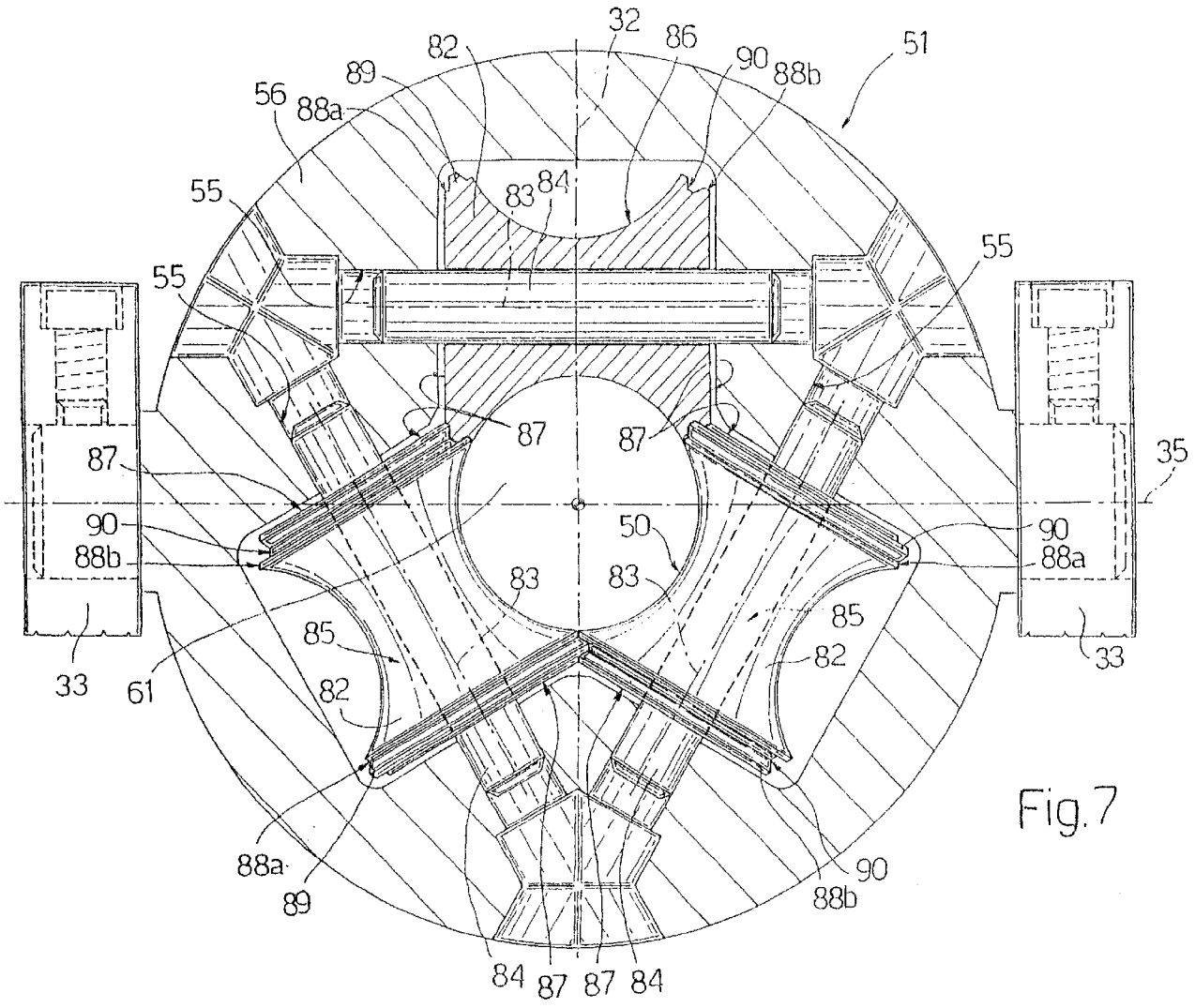
FIG. 7 shows a front elevation of a third variation of the FIG. 4 detail.

In the FIG. 7 variation, rollers 52 of bending head 51 are replaced with rollers 82, which, like rollers 52, define a passage section 50, rotate about respective axes 83, and are supported by respective pins 84 housed inside holes 55 in annular body 56. Each roller 82 comprises a surface 85 generated by rotation of a generating line 86 corresponding to a 120° arc; two lateral surfaces 87; and two connecting surfaces 88*a* and 88*b*. In the above variation, annular guide 50 comprises a circular passage section 61 with a barycenter 62, for bending pipes 63, which, as shown in FIG. 5*b*, comprise an axis 64, an outer surface 65, and a section S2 smaller than section S1. Each roller 82 differs from rollers 52 as regards connecting surfaces 88*a* and 88*b*, which, as opposed to being truncated-cone-shaped like connecting surfaces 60, respectively comprise a tooth 89 and a pocket 90, as shown in detail in FIGS. 8 and 9. Each tooth 89 and each pocket 90 are annular, extend about axis 83 of relative roller 82, and are complementary, in the sense that tooth 89 of one roller 82 engages pocket 90 of an adjacent roller.

In actual use, pipe 63 is bent as described previously, and, during the bending operation, offers a given resistance to bending, and transmits forces to at least one roller 82 of head 51. By virtue of tooth 89 and pocket 90, however, the roller 82 stressed by pipe 63 transmits part of the pipe-transmitted force to the adjacent rollers 82 to prevent relative displacement of the stressed roller 82 with respect to the adjacent rollers 82. Such displacements, normally due to slack and to material deformation, are particularly damaging by forming a step between the stressed roller 82 and the adjacent rollers 82, thus resulting in scoring of pipe 63.

Though the FIGS. 7, 8 and 9 variation refers specifically to head 51 with three rollers 82, the idea of preventing displacement of the rollers may be applied to advantage to any type of roller.

A common characteristic of heads 34, 51 and 66 lies in the generating lines 47, 58 and 73 of respective rollers 40, 52 and 67 corresponding to perimeter portions of respective passage sections 45, 61 and 76, and substantially to perimeter portions of the sections of pipes 2, 63 and 78.

As shown in the above examples, an infinite number of variations may be made to bending members 7, and in particular to the bending heads, depending on the shape and size of the pipe sections. Moreover, the bending heads are easily interchangeable on fork 33, as are the guide heads on plate 5.

In a variation not shown, rollers 40, 52 and 67 are provided with conical teeth formed along respective connecting surfaces 49, 60 and 75, so that all the rollers 40, 52, 67 of respective annular guides 50 rotate at the same speed about respective axes 41, 53 and 68.

In a further variation not shown, machine 1 comprises a known device (not showin) for rotating cylindrical pipes 2 and 63 about respective axes 3 and 64 between successive steps in the bending of pipes 2 and 63.

Rotating pipes 2 and 63 provides for positioning the bent portions of pipes 2 and 63 clear of machine 1, and so forming complex shapes.

In a further variation not shown, machine 1 comprises a device for pushing one end of pipe 2, 63, 78 in feed direction D1, and so feeding pipe 2, 63, 78 through device 6 and bending member 7 either in lieu of or jointly with drive rollers 12.

Machine 1 has numerous advantages: in particular, friction between pipe 2, 63, 78 and guide device 6 and bending member 7 is greatly reduced; the bent pipes 2, 63, 78 are no longer soiled with oil; heads 13, 34, 51 and 66 can be changed rapidly; and pipes of any section can be bent.

What is claimed is:

1. A machine for bending pipes (2; 63; 78) and sections having a given cross section (S1; S2; S3), the machine comprising: a guide device (6) for guiding said pipes (2; 63; 78), said guide device (6) having a longitudinal axis (9) for guiding said pipes (2; 63; 78) in a feed direction (D1) parallel to the axis (9); and a bending member (7) movable with respect to said guide device (6) in a plane (P1) perpendicular to said feed direction (D1), said bending member (7) comprising an annular guide (50) defining a passage section (45; 61; 76) for said pipes (2; 63; 78) substantially equal to the section (S1; S2; S3) of said pipes (2; 63; 78); said annular guide (50) being defined by rollers (40; 52; 82; 67); said rollers (40; 52; 82; 67) rotating about respective axes (41; 53; 68) coplanar with one another and with said passage section (45; 61; 76); each of said rollers (40; 52; 82; 67) having a surface of revolution (44; 57; 85; 72) generated by rotation of a respective generating line (47; 58; 86; 73); said generating lines (47; 58; 86; 73) collectively defining a perimeter portion of said passage section (45; 61; 76); each of said rollers (40; 52; 82; 67) comprising two connecting surfaces (88*a*, 88*b*) on opposite sides of the surface of the revolution (44; 57; 85; 72); each connecting surface (88*a*; 88*b*) contacting the connecting surface (88*b*; 88*a*) of an adjacent roller (40; 52; 82; 67) to prevent a displacement of each roller (40; 52; 82; 67) with respect to the adjacent rollers (40; 52; 82; 67).

2. A machine as claimed in claim 1, characterized in that said annular guide (50) is defined by four rollers (40; 67); the axes (41; 68) of adjacent rollers (40; 67) being perpendicular to each other.

3. A machine as claimed in claim 2, characterized in that said surface of revolution (72) is cylindrical; said passage section (76), being square.

4. A machine as claimed in claim 1, characterized in that said surface of revolution (44; 57; 85) is toroidal; said passage section (45; 61) being circular.

5. A machine as claimed in claim 1, characterized in that said annular guide (50) is defined by three rollers (52; 82); the axes (53) of adjacent rollers (52; 82) forming an equilateral triangle.

6. A machine as claimed in claim 1, characterized in that said bending member (7) comprises a bending head (34; 51; 66) in turn comprising said rollers (40; 52; 82; 67) and a fork (33) supporting said head (34; 51; 66); said head (34; 51; 66) rotating about a horizontal axis (35) with respect to said fork (33); and said fork (33) rotating about a vertical axis (32) with respect to said guide device (6).

7. A machine as claimed in claim 6, characterized in that said head (34; 51; 66) is connected interchangeably to the fork (33).

8. A machine as claimed in claim 1, characterized in that said guide device (6) comprises a guide head (13) defining an annular guide (50); said head (13) being interchangeable.

9. A machine as claimed in claim 1, characterized by comprising a plate (5) supporting said guide device (6) and an actuating assembly (8) for activating said bending member (7) supported by said plate (5); said actuating assembly (8) comprising three slides (18, 23, 25) movable in three directions (D1, D2, D3) perpendicular to one another.

10. A machine as claimed in claim 1, characterized in that each of said rollers (40; 52; 67) comprises two ring gears on opposite sides of said surface of revolution (44; 57; 72); each ring gear meshing with the ring gear of the adjacent roller (40; 52; 67) so that the rollers (40; 52; 67) all rotate at the same speed about the respective axes (41; 53; 68).

11. A machine as claimed in claim 1, characterized in that said connecting surfaces (88*a*; 88*b*) comprise a first and a second connecting surface; said first connecting surface (88*a*) comprising an annular tooth (89); and said second connecting surface comprising an annular pocket (90) for housing the tooth (89) of the adjacent roller.

12. A machine as claimed in claim 11, characterized in that, in said head (51), the respective annular tooth (89) of each roller (82) engages a pocket (90) of the adjacent roller (82).

13. A machine for bending pipes (2; 63; 78) and sections having a given cross section (S1; S2; S3), the machine comprising: a guide device (6) for guiding said pipes (2; 63; 78), said guide device (6) having a longitudinal axis (9) for guiding said pipes (2; 63; 78) in a feed direction (D1) parallel to the axis (9); and a bending member (7) movable with respect to said guide device (6) in a plane (P1) perpendicular to said feed direction (D1), said bending member (7) comprising an annular guide (50) defining a passage section (45; 61; 76) for said pipes (2; 63; 78) substantially equal to the section (S1; S2; S3) of said pipes (2; 63; 78); said annular guide (50) being defined by rollers (40; 52; 82; 67); said rollers (40; 52; 82; 67) rotating about respective axes (41; 53; 68) coplanar with one another and with said passage section (45; 61; 76); each of said rollers (40; 52; 82; 67) having a surface of revolution (44; 57; 85; 72) generated by rotation of a respective generating line (47; 58; 86; 73); said generating lines (47; 58; 86; 73) collectively defining a perimeter portion of said passage section (45; 61; 76); each of said rollers (40; 52; 82; 67) comprising two connecting surfaces (88*a*, 88*b*) on opposite sides of the surface of the revolution (44; 57; 85; 72); each connecting surface (88*a*; 88*b*) contacting the connecting surface (88*b*; 88*a*) of an adjacent roller (40; 52; 82; 67) to prevent a displacement of each roller (40; 52; 82; 67) with respect to the adjacent rollers (40; 52; 82; 67), and wherein said connecting surfaces (88*a*, 88*b*) comprise a first and a second connecting surface; said first connecting surface (88*a*) comprising an annular tooth (89) which extends about an axis (83) of the roller (82); and said second connecting surface comprising an annular pocket (90) for housing the tooth (89) of the adjacent roller (82).

* * * * *